US007856684B2

(12) United States Patent
Robertson et al.

(10) Patent No.: US 7,856,684 B2
(45) Date of Patent: Dec. 28, 2010

(54) FITTED BED SHEETS AND METHODS FOR MAKING THE SAME

(75) Inventors: James B. Robertson, Libertyville, IL (US); Natallie N. O'Connor, Palatine, IL (US)

(73) Assignee: Medline Industries, Inc., Mundelein, IL (US)

( * ) Notice: Subject to any disclaimer, the term of this patent is extended or adjusted under 35 U.S.C. 154(b) by 542 days.

(21) Appl. No.: 11/890,325

(22) Filed: Aug. 6, 2007

(65) Prior Publication Data

US 2008/0028523 A1 Feb. 7, 2008

Related U.S. Application Data

(60) Provisional application No. 60/836,096, filed on Aug. 7, 2006, provisional application No. 60/879,201, filed on Jan. 8, 2007.

(51) Int. Cl.
*A47G 9/02* (2006.01)

(52) U.S. Cl. ..... 5/497; 5/495; 5/485

(58) Field of Classification Search ..... 5/482, 5/485, 497–499, 495

See application file for complete search history.

(56) References Cited

U.S. PATENT DOCUMENTS 2,799,870 A 7/1957 Sullivan
3,181,179 A * 5/1965 Roddey, Jr. ..... 5/497
3,380,086 A 4/1968 McCurry
3,956,782 A 5/1976 Morrison
4,045,831 A 9/1977 Clark
4,642,826 A 2/1987 Bassetti
4,723,331 A 2/1988 Weiss
4,912,790 A 4/1990 Macdonald
5,008,966 A 4/1991 Lepow
5,042,098 A 8/1991 Stultz
5,142,718 A 9/1992 Anderson et al.
5,325,555 A 7/1994 Whitley
5,603,132 A 2/1997 Zafiroglu
5,765,241 A * 6/1998 Macdonald ..... 5/497
6,164,092 A 12/2000 Menaker
6,311,525 B1 11/2001 Marker et al.

* cited by examiner

*Primary Examiner*—Fredrick Conley
(74) *Attorney, Agent, or Firm*—Nixon Peabody LLP

(57) ABSTRACT

A fitted bed sheet is disclosed. The bed sheet comprises a generally rectangular middle portion having a first fold line on a first edge and a second fold line on a second opposing edge. The bed sheet further comprises a first side portion having a generally concave shape. The first side portion is folded along the first fold line. The bed sheet further comprises a second side portion having a generally concave shape. The second side portion is folded along the second fold line such that the second side portion contacts the first side portion. The first side portion, the middle portion and the second side portion are coupled along opposing ends generally perpendicular to the first fold line and the second fold line.

30 Claims, 8 Drawing Sheets

FITTED BED SHEETS AND METHODS FOR MAKING THE SAME

CROSS-REFERENCE TO RELATED APPLICATION

This application claims the benefit of U.S. Provisional Application No. 60/836,096, filed Aug. 7, 2006, and U.S. Provisional Application No. 60/879,201, filed Jan. 8, 2007, both of which are hereby incorporated by reference in their entirety.

FIELD OF THE INVENTION

The present invention relates generally to fitted bed sheets and, more particularly, to fitted bed sheets having a crossover-type configuration that is relatively easy to put over a mattress and that covers a larger portion of the mattress.

BACKGROUND OF THE INVENTION

Fitted bed sheets have been used in hospitals, nursing homes, and other healthcare facilities for many years. These sheets are often made from knitted materials such as cotton, polyester, blends thereof, or the like. Fitted bed sheets generally provide a type of barrier between a patient and the mattress, thereby providing comfort and inhibiting cross-contamination.

Existing fitted bed sheets often do not sufficiently cover the underside of a mattress, causing the fitted bed sheets to become untucked and come off of the mattress. The underlying mattress may then become exposed, which may cause discomfort to a patient lying on the mattress. Furthermore, the exposed mattress may contact the patient's skin, causing bacteria and/or microbes from the mattress to be transferred to the patient and vice versa. Because hospitals, nursing homes, and other healthcare facilities often do not clean the mattresses frequently enough and/or sufficiently, this cross-contamination may cause significant hygiene issues, which may affect the health of the patient.

Furthermore, many existing fitted bed sheets do not fit the mattress tightly enough, which may cause the fitted bed sheets to wrinkle. The ill-fitting fitted bed sheets may also bunch up on one end or side of the mattress, thereby causing inconvenience and/or discomfort to the patient. In addition, it may take longer to change fitted bed sheets that do not fit properly, as more time will be spent adjusting the fitted bed sheets to fit the mattress. Moreover, a wrinkled or bunched-up fitted bed sheet surface may irritate a patient's skin, thereby causing rashes or sores.

Therefore, there exists a need for a fitted bed sheet that addresses one or more of these deficiencies.

SUMMARY OF THE INVENTION

In one aspect of the present invention, a fitted bed sheet is disclosed. The bed sheet comprises a generally rectangular middle portion having a first fold line on a first edge and a second fold line on a second opposing edge. The bed sheet further comprises a first side portion having a generally concave shape. The first side portion is folded along the first fold line. The bed sheet further comprises a second side portion having a generally concave shape. The second side portion is folded along the second fold line such that the second side portion contacts the first side portion. The first side portion, the middle portion, and the second side portion are coupled along opposing ends generally perpendicular to the first fold line and the second fold line.

In one process of the present invention, a method of forming a fitted bed sheet is disclosed. The method comprises the act of providing a piece of fabric having a first fold line and a second fold line dividing the fabric into three portions including a first generally concave side portion, a generally rectangular middle portion, and a second generally concave side portion. The method further comprises folding the piece of fabric along the first fold line such that the first side portion overlaps the middle portion. The method further comprises folding the piece of fabric along the second fold line such that the second side portion overlaps the first side portion and the middle portion. The method further comprises coupling the middle portion, the first side portion, and the second side portion at opposing ends generally perpendicular to the first fold line and the second fold line.

In another aspect of the present invention, a fitted bed sheet is disclosed. The bed sheet comprises a generally rectangular middle portion having opposing longer edges and opposing shorter edges. The bed sheet further comprises a first side portion extending from one of the opposing longer edges of the middle portion. The first side portion has a generally concave peripheral edge. The bed sheet further comprises a second side portion extending from the other of the opposing longer edges of the middle portion. The second side portion has a generally concave peripheral edge. The bed sheet further comprises a first fold line located between the middle portion and the first side portion. The bed sheet further comprises a second fold line located between the middle portion and the second side portion. The first side portion is folded along the first fold line such that the first side portion contacts the middle portion. The second side portion is folded along the second fold line such that the second side portion contacts the first side portion and the middle portion. The opposing shorter ends of the middle portion are coupled to opposing adjacent edges of the second side portion.

The above summary of the present invention is not intended to represent each embodiment or every aspect of the present invention. The detailed description and Figures will describe many of the embodiments and aspects of the present invention.

BRIEF DESCRIPTION OF THE DRAWINGS

The foregoing and other advantages of the invention will become apparent upon reading the following detailed description and upon reference to the drawings.

Figure 1:
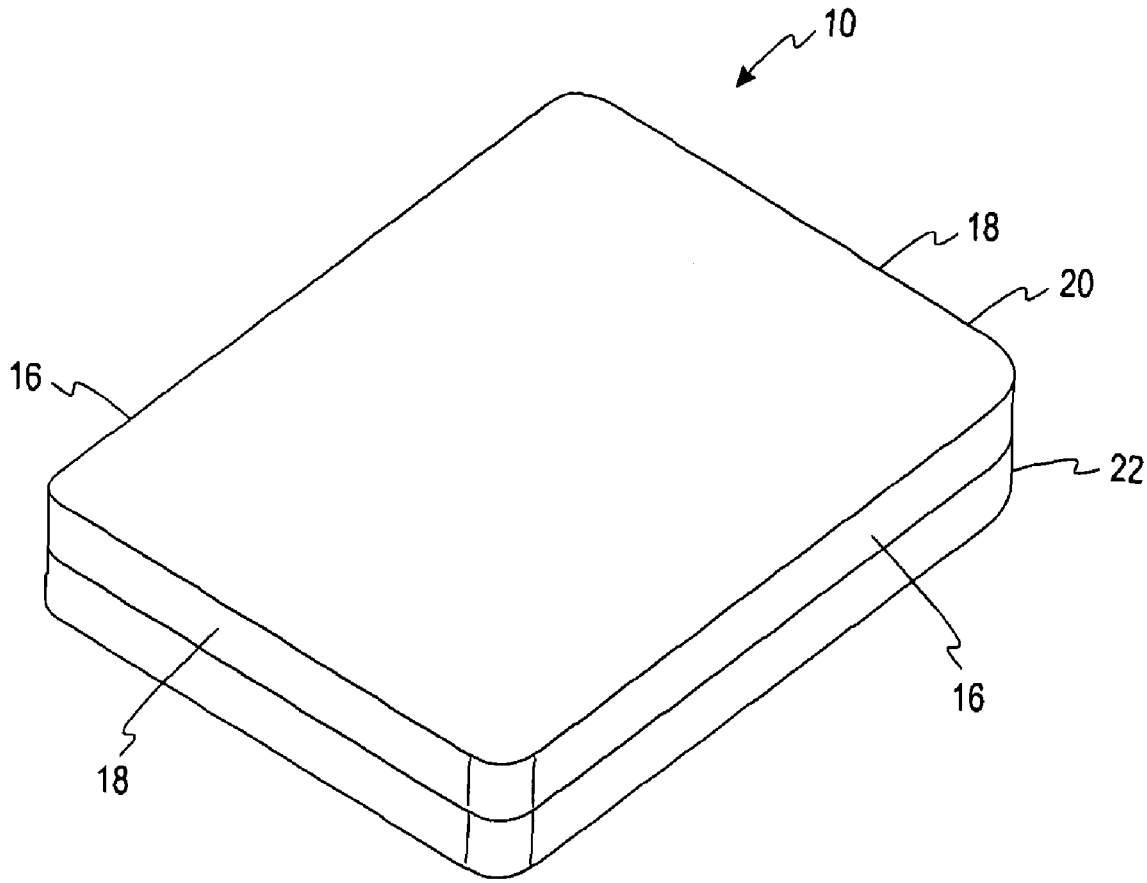
FIG. 1 shows a top perspective view of a fitted bed sheet placed onto a mattress according to one embodiment of the present invention.

While this invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention.

DESCRIPTION OF ILLUSTRATIVE EMBODIMENTS

The present concepts are directed to a fitted bed sheet 10 as shown, for example, in FIG. 1. The fitted bed sheet 10 is adapted to fit over a top of a mattress 20 and extend around opposing sides 16 and opposing ends 18 of the mattress 20. As shown in FIG. 1, the mattress 20 having the fitted bed sheet 10 placed thereon may typically be placed on top of another mattress or box spring 22. In this arrangement, part(s) (e.g., edges) of the fitted bed sheet 10 is located between the mattress 20 and the other mattress or box spring 22.

The fitted bed sheets of the embodiments of the present concepts have an overlapping, crossover-type configuration. The fitted bed sheets may be constructed using a fabric blank such as, for example, a fabric blank 30 shown in FIG. 2*a*. The size of the fabric blank 30 may vary depending on the size of the mattress on which the resulting fitted bed sheet (e.g., fitted bed sheet 10) is adapted to fit. The length L of the fabric blank 30 may, for example, generally range from about 70 inches (about 177 cm) to about 85 inches (about 216 cm). The width W of the fabric blank 30 may, for example, generally range from about 105 inches (about 266 cm) to about 120 inches (about 305 cm). It is contemplated that the fabric blank 30 may have other dimensions. Other fabric blanks (e.g., fabric blank 65 of FIG. 2*b*, fabric blank 66 of FIG. 3) may have similar dimensions.

Figure 2A:
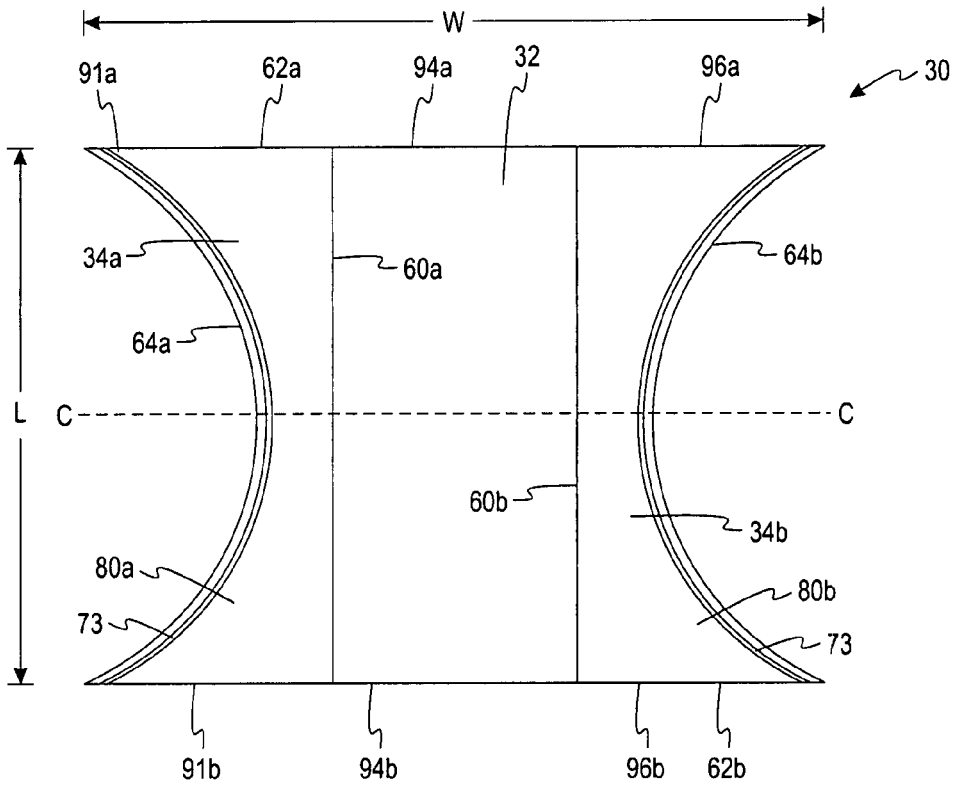
FIG. 2*a* shows a top view of a fabric blank according to one embodiment of the present invention.
Figure 2B:
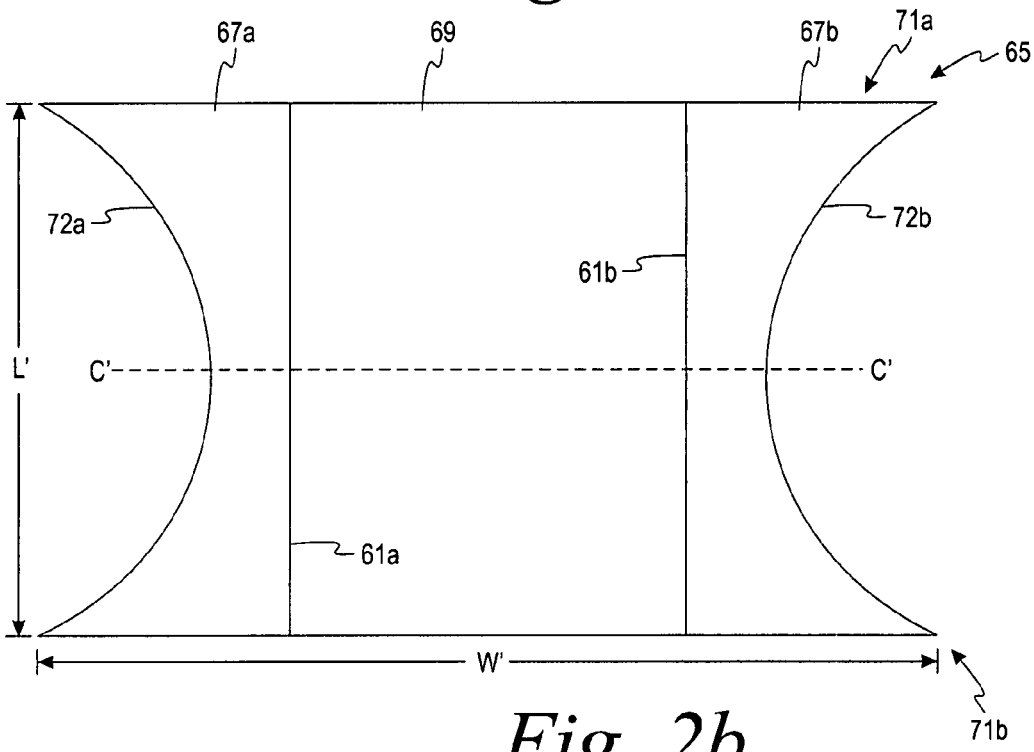
FIG. 2*b* shows a top view of a fabric blank according to another embodiment of the present invention.

The fabric blank 30 may include a middle portion 32, a first side portion 34*a*, and an opposing second side portion 34*b*. The first side portion 34*a* and the middle portion 32 are generally separated by a first fold line 60*a*. The middle portion 32 and the second side portion 34*b* are generally separated by a second fold line 60*b*. In the embodiment of FIG. 2*a*, the first and second fold lines 60*a*, 60*b* generally divide the width W of the fabric blank 30 into three generally equal portions (i.e., middle portion 32, first side portion 34*a*, second side portion 34*b*). In other embodiments, however, the fold lines may divide the width of the fabric blank into generally unequal portions. Referring to FIG. 2*b*, for example, a first fold line 61*a* and a second fold line 61*b* divide a fabric blank 65 into a first side portion 67*a*, a second side portion 67*b*, and a middle portion 69 such that the widths of the first and second side portions 67*a*, 67*b* are different (e.g., smaller) than the width of the middle portion 69. The first fold line 60*a*, 61*a* and the second fold line 60*b*, 61*b* are generally not visible on the fabric blank 30, 65. It is contemplated, however, that the first fold line 60*a*, 61*a* and/or the second fold line 60*b*, 61*b* may be visible by means of a marking, a seam, combinations thereof, or the like. Other types of fabric blanks in accordance with the present concepts may have a similar structure and/or similar characteristics.

According to embodiments of the present concepts, the width W, W' of the fabric blank 30, 65 is generally greater at a top end 62*a*, 71*a* and a bottom end 62*b*, 71*b* than at or near the center region of the length L, L' (e.g., line C-C, line C'-C'). Referring to FIG. 2*a*, for example, the first side portion 34*a* and the second side portion 34*b* of the fabric blank 30 have generally curved, concave edges 64*a*, 64*b*, thereby giving the fabric blank 30 a generally hourglass shape. The amount and degree of curvature of the concave edges 64*a*, 64*b* may vary. For example, the curvature of generally concave edges 72*a*, 72*b* of the fabric blank 65 of FIG. 2*b* is greater than the curvature of the generally concave edges 64*a*, 64*b* of the fabric blank 30 of FIG. 2*a*. As one non-limiting example, the width of the fabric blank at or near the center region of the length L, L' may generally range from about 50 inches (about 127 cm) to about 70 inches (about 178 cm).

Figure 3:
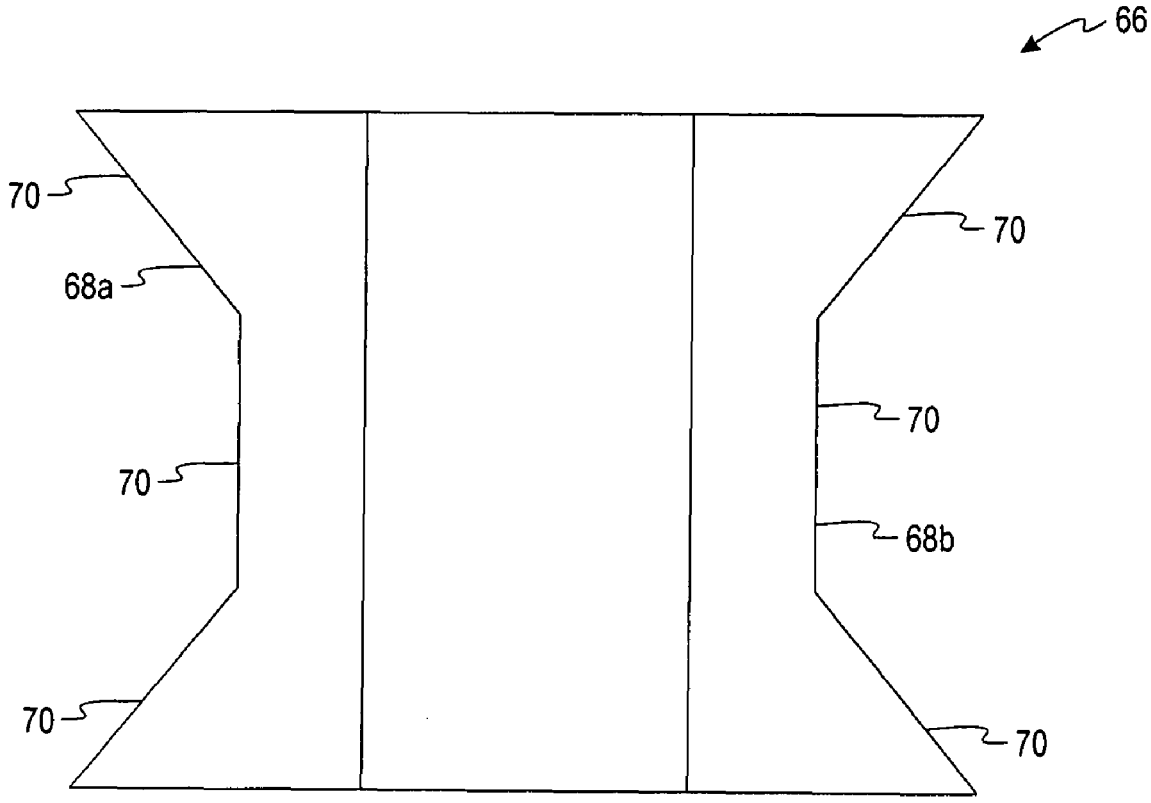
FIG. 3 shows a top view of a fabric blank according to yet another embodiment of the present invention.

According to another embodiment shown in FIG. 3, a fabric blank 66 includes generally concave edges 68*a*, 68*b* formed using several generally straight line segments 70. Although each concave edge 68*a*, 68*b* of the fabric blank 66 of FIG. 3 includes three line segments 70 of generally uniform length, it is contemplated that a different number of line segment(s) 70 having varying lengths may be used to create a generally concave shape along the generally concave edges 68*a*, 68*b*. Furthermore, although the line segments 70 of FIG. 3 are generally straight, it is contemplated that other types of line segments (e.g., zigzag, wavy, curved, or the like) may also be used.

Referring back to FIG. 2*a*, for example, it may be desirable for the concave edge(s) 64*a*, 64*b* to be hemmed. It may also be desirable for the concave edge(s) 64*a*, 64*b* to have a trim, a hem, or a bias binding 73. A trim generally includes an end(s) of the fabric being folded over and stitched or sewn. A bias binding 73 generally includes a strip(s) of fabric located at or near the concave edge(s) 64*a*, 64*b*. The bias binding 73 may be folded around the concave edge(s) 64*a*, 64*b* of the fabric blank 30 and sewn or otherwise attached thereon. The bias binding 73 may assist in preventing fraying, provide flexibility to stretch over a mattress, have colored threads to assist in sorting of multiple fitted bed sheets, or the like. It is contemplated that a hem, trim, or bias binding may be used in any of the embodiments described herein.

Figure 4A:
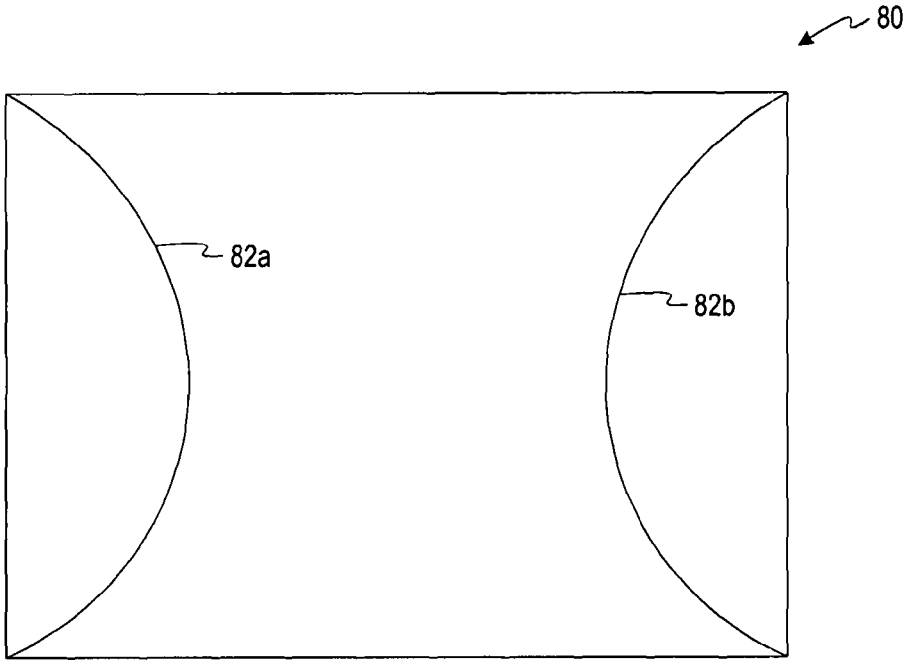
FIG. 4*a* shows a top view of a fabric sheet used to form the fabric blank of FIG. 2*a* according to one embodiment.

A fabric blank (e.g., fabric blank 30 of FIG. 2*a*, fabric blank 65 of FIG. 2*b*, or fabric blank 66 of FIG. 3) of the various embodiments described herein may be manufactured using any suitable technique. According to one embodiment shown in FIG. 4*a*, for example, the generally hourglass shape of the fabric blank 30 of FIG. 2*a* results from a generally rectangular fabric sheet 80 being cut along cut lines 82*a*, 82*b* to form the opposing concave edges 64*a*, 64*b* of the fabric blank 30 of FIG. 2*a*. The fabric sheet 80 and/or portions thereof may be comprised of several different pieces of fabric attached to achieve a desired length and width. Similar techniques may be used to form the fabric blanks (e.g., fabric blanks 65, 66) of other embodiments described herein.

Figure 4B:
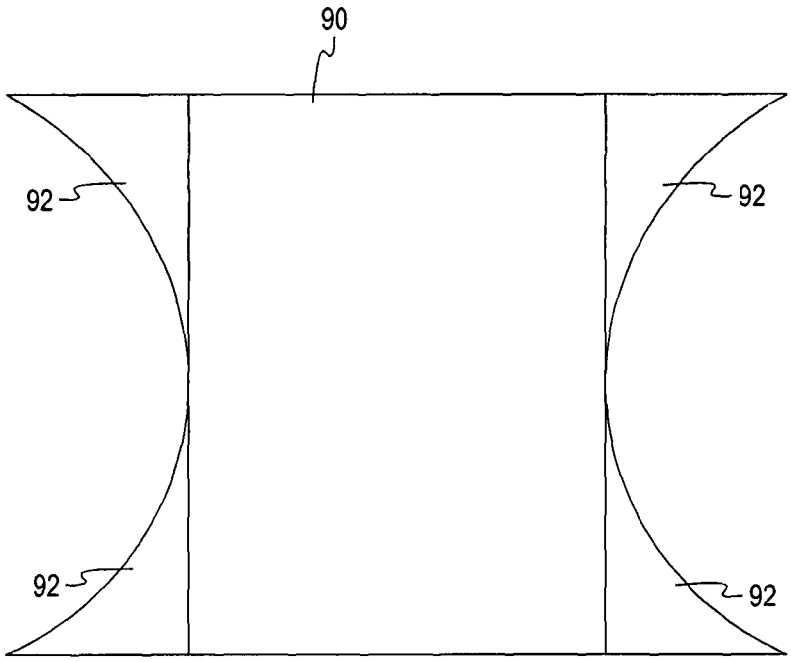
FIG. 4*b* shows a top view of a fabric blank according to yet another embodiment of the present invention.

According to another embodiment described herein shown in FIG. 4*b*, the generally hourglass shape of the fabric blank 30 of FIG. 2*a* may result from a generally rectangular piece of fabric 90 having two or more curved end pieces of fabric 92 attached thereto. Although the embodiment of FIG. 4*b* utilizes five pieces of fabric 90, 92, it is contemplated that any number of fabric pieces having any suitable shape(s) and/or size(s) may be used to form the fabric blank (e.g., fabric blank 30, 65, 66) of the embodiments of present concepts. It is further contemplated that the fabric blank 30, 65, 66 and/or portions thereof may be comprised of several different pieces of fabric attached to achieve a desired length and/or width.

Referring back to FIG. 2*a*, in one non-limiting example, the length L of the fabric blank 30 is about 70 inches (about 177 cm) to about 85 inches (about 216 cm), and the width of the fabric blank 30 is about 105 inches (about 266 cm) to about 120 inches (about 305 cm). In this example, the width W of the fabric blank 30 measured at line C-C generally through the center of the fabric blank 30 is about 55 inches (about 139 cm) to about 60 inches (about 153 cm). It is contemplated, however, that the fabric blanks of the embodiments of the present concepts may also have other suitable dimensions.

Referring to FIG. 2*b*, in another non-limiting example, the width of the fabric blank 65 is about 65 inches (about 165 cm) to about 85 inches (about 216 cm). In this example, the width W' of the fabric blank 65 measured at the line C'-C' generally through the center of the fabric blank 65 is about 55 inches (about 139 cm) to about 60 inches (about 153 cm). Thus, the curvature of the concave edges 72*a*, 72*b* of the fabric blank 65 of FIG. 2*b* is greater than the curvature of the concave edges 64*a*, 64*b* of the fabric blank 30 of FIG. 2*a*.

Figure 5A:
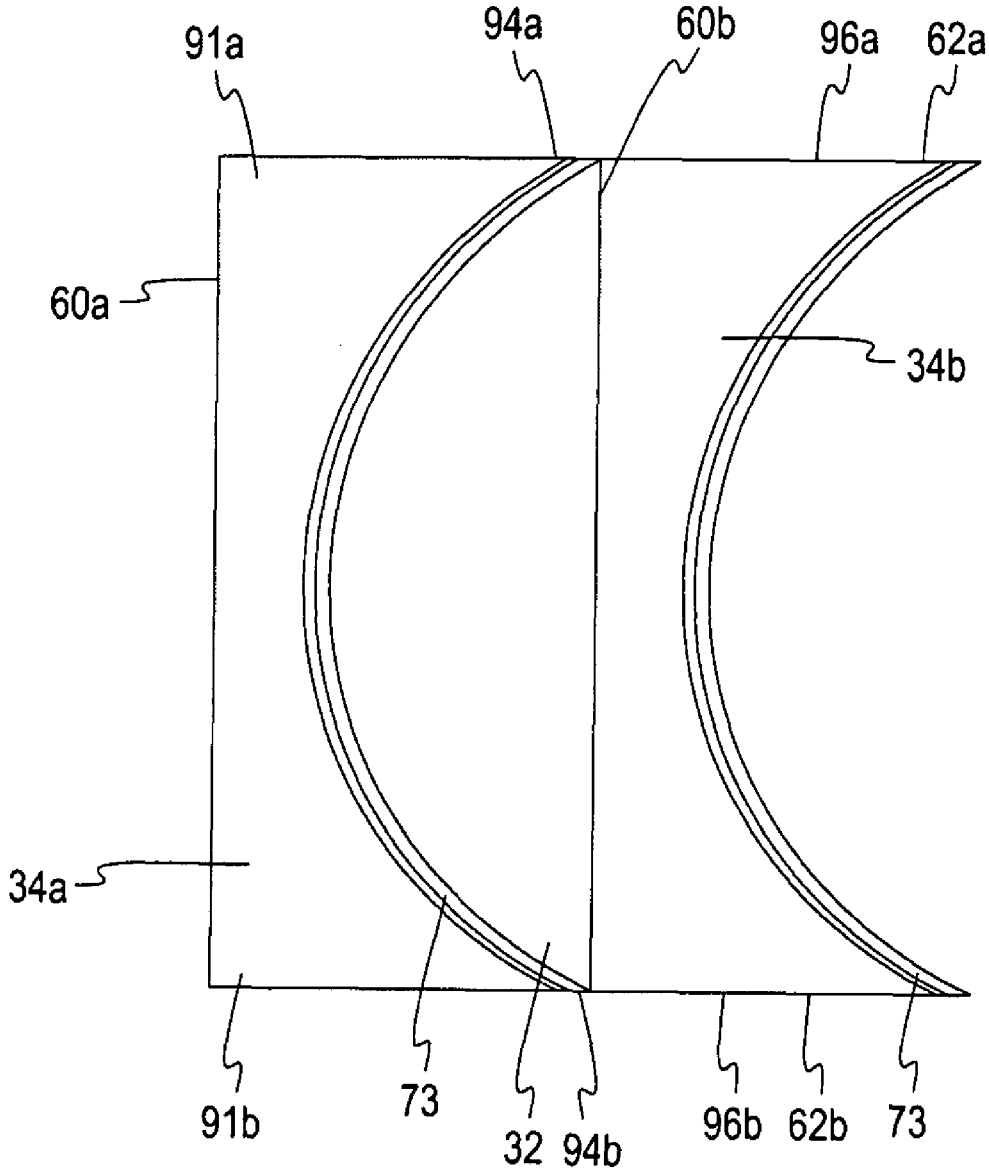
FIG. 5*a* shows a bottom view of the fabric blank of FIG. 2*a* with a side portion folded along a fold line.
Figure 5B:
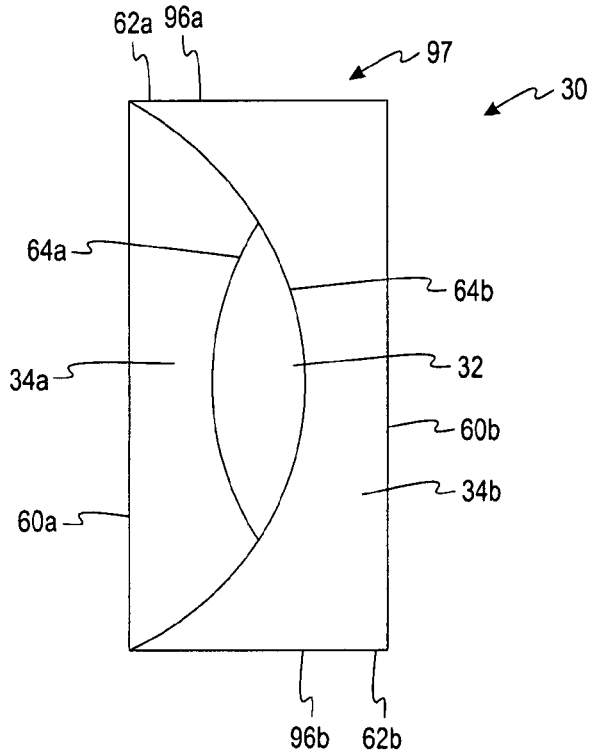
FIG. 5*b* shows a bottom view of a fitted bed sheet according to one embodiment of the present invention.

Referring again to FIG. 2*a*, the fabric blank 30 is used to form a fitted bed sheet (e.g., fitted bed sheet 10 of FIG. 1) according to one embodiment of the present concepts. The fabric blank 30 may be folded in a generally two-step process. The first side portion 34*a* is folded along the first fold line 60*a* such that the first side portion 34*a* is generally flush with the middle portion 32, as shown in FIG. 5*a*. A top end 91*a* and an opposing bottom end 91*b* of the first side portion 34*a* may then be attached to a top end 94*a* and an opposing bottom end 94*b*, respectively, of the middle portion 32 to form a fitted bed sheet. The second side portion 34*b* may then be folded along the second fold line 60*b* such that a portion of the second side portion 34*b* overlaps a portion of the first side portion 34*a*, as shown in FIG. 5*b*. A top end 96*a* and an opposing bottom end 96*b* of the second side portion 34*b* may then be attached to the top end 94*a* and the bottom end 94*b*, respectively, of the middle portion 32. It is contemplated that the folding may be done in reverse order. For example, the second side portion 34*b* may be folded first along the second fold line 60*b* followed by the first side portion 34*a* being folded along the first fold line 60*a*. It is contemplated that similar techniques may be employed using various types and/or designs of fabric blanks. A similar process may be used to form other embodiments of the fitted bed sheets described herein (e.g., using the fabric blank 65 of FIG. 2*b* to form a fitted bed sheet 101 of FIG. 7).

According to another embodiment, the top and bottom ends 91*a*, 91*b* of the first side portion 34*a* and the top and bottom ends 96*a*, 96*b* of the second side portion 34*b* may be attached to the respective top and bottom ends 94*a*, 94*b* of the middle portion 32 at the same time. In this embodiment, after the first side portion 34*a* is folded along the first fold line 60*a* and the second side portion 34*b* is folded along the second fold line 60*b*, the top ends 91*a*, 94*a*, 96*a* are attached and the bottom ends 91*b*, 94*b*, 96*b* are attached. This embodiment may be desirable because it may eliminate a process step by allowing for the middle portion 32, the first side portion 34*a*, and the second side portion 34*b* to be attached in a single step rather than attaching each of the first side portion 34*a* and the second side portion 34*b* to the middle portion 32 in separate steps. It is contemplated that the folding may be done in reverse order. For example, the second side portion 34*b* may be folded first along the second fold line 60*b* followed by the first side portion 34*a* being folded along the first fold line 60*a*. It is contemplated that similar techniques may be employed using various types and/or designs of fabric blanks. A similar process may be used to form other embodiments of the fitted bed sheets described herein (e.g., using the fabric blank 65 of FIG. 2*b* to form the fitted bed sheet 101 of FIG. 7).

It is contemplated that any suitable means of attachment may be used to attach the first side portion (e.g., first side portion 34*a* of FIG. 2*a*) and the second side portion (e.g., second side portion 34*b* of FIG. 2*a*) to the middle portion (e.g., middle portion 32 of FIG. 2*a*). Non-limiting examples of such attachment means for any of the embodiments of the fitted bed sheets described herein include, but are not limited to, stitching, sewing, overlock stitching, or the like.

Figure 5C:
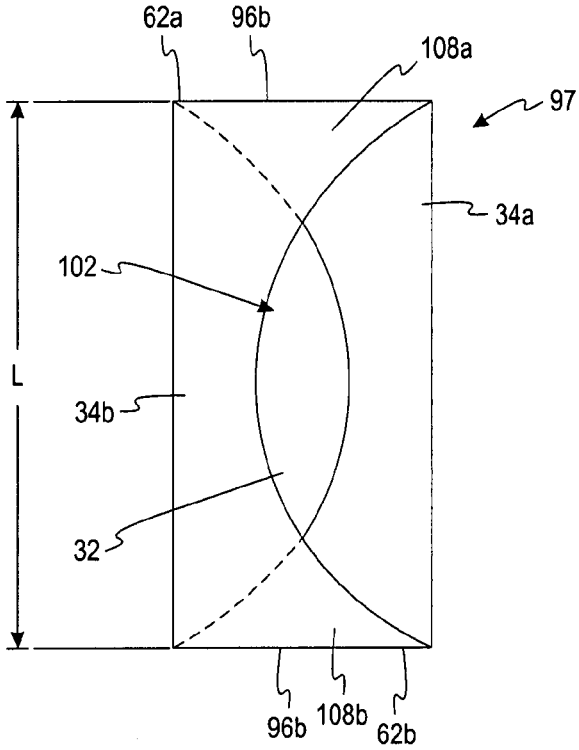
FIG. 5*c* shows a bottom view of the fitted bed sheet of FIG. 5*b* turned inside out.

FIG. 5*b* shows a resulting fitted bed sheet 97 in a flat position. The fitted bed sheet 97 may then be turned inside out, as shown in FIG. 5*c*. Turning the fitted bed sheet 97 inside out may assist in hiding the stitching and/or seams. It is contemplated that these attachment means may be used with any of the embodiments described herein.

Figure 6:
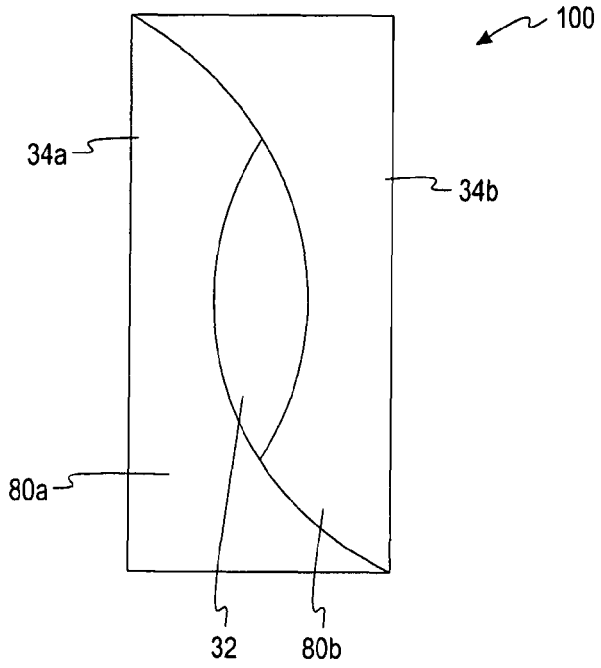
FIG. 6 shows a bottom view of a fitted bed sheet according to another embodiment of the present invention.

Referring back to FIG. 2*a*, according to another embodiment, after the second side portion 34*b* is folded along the second fold line 60*b*, a bottom portion 80*b* of the second side portion 34*b* is positioned under a bottom portion 80*a* of the first side portion 34*a*, resulting in a bed sheet 100 shown in FIG. 6. The ends of each of the first side portion 34*a* and the second side portion 34*b* may be attached to the respective ends of the middle portion 32 either individually (the first side portion 34*a* being attached to the middle portion 32 followed by the second side portion 34*b* being attached to the middle portion 32) or simultaneously, as described above. It is contemplated that the folding order of this embodiment may be reversed, such that the bottom portion 80*a* of the first side portion 34*a* is tucked under the bottom portion 80*b* of the second side portion 34*b*.

Referring back to FIG. 5*c*, the fitted bed sheet 97 includes an aperture 102 formed between the first side portion 34*a* and the second side portion 34*b*. Because the top and bottom ends 91*a*, 91*b* (see FIGS. 2*a*, 5*a*) of the first side portion 34*a* overlap with the top and bottom ends 96*a*, 96*b* of the second side portion 34*b*, the length of the aperture 102 is less than the length L of the fitted bed sheet 97. The aperture 102 may, for example, range from about 65% to about 95% of the length L of the fitted bed sheet 97. It is contemplated, however, that the aperture 102 may have other suitable lengths (e.g., less than 65% of the length of the fitted bed sheet 97) depending on a number of factors such as length of the mattress, the width of the mattress and the like. The aperture 102 is adapted to assist in placing the fitted bed sheet 97 over a mattress (e.g., mattress 20 of FIG. 1). Because the aperture 102 is relatively small with respect to the fitted bed sheet 97 and the mattress that the fitted bed sheet 97 is intended to cover, it may be desirable for the fitted bed sheet 97 to be comprised of a material that allows the fitted bed sheet 97 to stretch. The use of stretchable material also allows the fitted bed sheet 97 to better fit mattresses of various sizes. It may also be desirable for the fitted bed sheet 97 to be comprised of materials that are comfortable to a user and that are adapted to keep the fitted bed sheet 97 secured to the mattress. Non-limiting examples of materials that may be used to manufacture the fitted bed sheet 97 include cotton, polyester, spandex, combinations thereof, or the like. It is contemplated that these types of materials may be used with any of the embodiments described herein.

Figure 7:
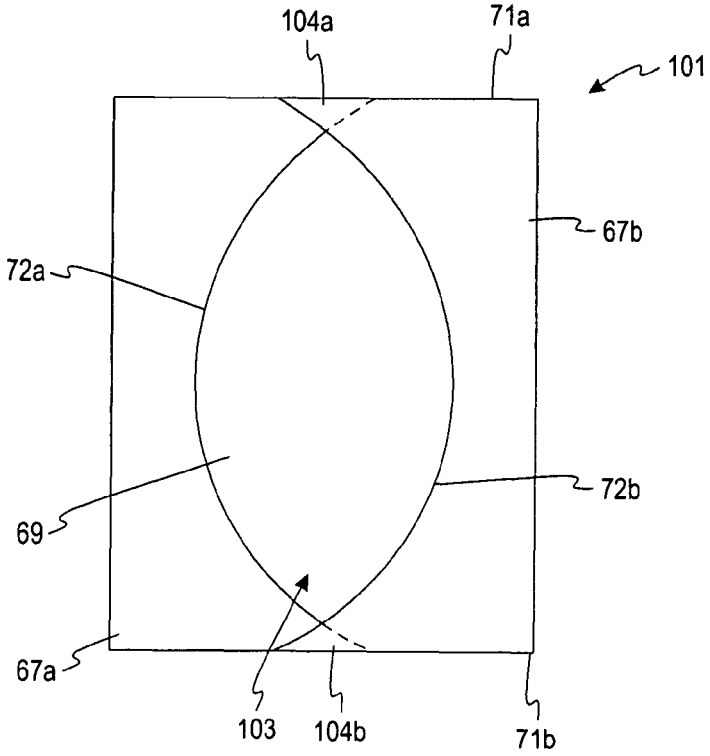
FIG. 7 shows a bottom view of a fitted bed sheet according to another embodiment.

Turning now to FIG. 7, a fitted bed sheet 101 according to another embodiment is illustrated. The fitted bed sheet 101 may be formed from the fabric blank 65 of FIG. 2*b* using any of the processes described above or any other suitable process. Because the width of the middle portion 69 is greater than the width of the first and second side portions 67*a*, 67*b* (see FIG. 2*b*), the width and length of an overlapping portion 104*a* at the top end 71*a* and an overlapping portion 104*b* at the bottom end 71*b* is smaller than the length of an overlapping portion 108*a* at the top end 62*a* and an overlapping portion 108*b* at the bottom end 62*b* of the fitted bed sheet 97 formed using the fabric blank 30 of FIG. 2*a* (see FIGS. 5*b*, 5*c*). Accordingly, a longer aperture 103 is formed using the fabric blank 65 of FIG. 2*b* versus the shorter aperture 102 formed using the fabric blank 30 of FIGS. 2*a*, 5*a-c* (compare FIG. 7 to FIGS. 5*b*, 5*c*). Additionally or alternatively, the width of the aperture 103 may be increased (i.e., by increasing the concavity of the first and second edges 72*a*, 72*b*) versus the narrower aperture 102 formed using the fabric blank 30 of FIGS. 2*a*, 5*a-c* (compare FIG. 7 to FIGS. 5*b*, 5*c*). Increasing the length and/or the width of the aperture 103 may be desirable so that the fitted bed sheet 101 may be more readily placed onto a corresponding mattress.

According to one embodiment, the length of each overlapping portion 104*a*, 104*b* of FIG. 7 generally ranges from about 3 inches (about 7 cm) to about 5 inches (about 13 cm). It is contemplated that the length of the overlapping portions 104*a*, 104*b*, 108*a*, 108*b* may also have other lengths and/or that the length of the overlapping portion 108*a*, 104*a* at the top end 62*a*, 71*a* may be different from the length of the overlapping portion 108*b*, 104*b* at the bottom end 62*b*, 71*b*.

The fitted bed sheets of the embodiments of the present concepts may be formed using various methods described herein or obvious variations thereof. The weight percentage(s) of the material(s) used to manufacture the fitted bed sheets may be selected based on a variety of factors that provide desirable performance characteristics to the fitted bed sheets such as softness, breathability, stretchability, durability, drying characteristics, combinations thereof, and the like. The weight percentage(s) of the material(s) may also be selected based on cost considerations. The fitted bed sheets may, for example, be comprised of from about 50% by weight to 100% by weight cotton and from about 40% by weight to 100% by weight polyester. The fitted bed sheets may also be comprised of about 1% to about 15% by weight spandex. Other compositions of material for use in the fitted bed sheets are also contemplated. Cotton, polyester, and spandex materials that may be used with the present concepts are commercially available from numerous suppliers worldwide. It is contemplated that different parts of the fitted bed sheets may be made of different types and/or weight percentages of materials.

The dimensions of the fitted bed sheets may correspond with the types of materials used to make the fitted bed sheets. For example, a larger-sized fitted bed sheet may require a smaller amount of elasticity in the material used to make the fitted bed sheet. Similarly, smaller-sized fitted bed sheets may require a larger amount of elasticity in the material used to make the fitted bed sheet. For example, according to one embodiment of the present concepts, a fitted bed sheet is comprised of about 55% by weight cotton and about 45% by weight polyester and has a length of about 85 inches (about 215 cm) to about 90 inches (about 229 cm) and a width of about 35 inches (about 88 cm) to about 40 inches (about 102 cm). According to another embodiment, a fitted bed sheet is comprised of about 45% by weight to about 55% by weight cotton, about 35% by weight to about 45% by weight polyester, and about 1% by weight to about 15% by weight spandex and has a length of about 80 inches (about 203 cm) to about 85 inches (about 216 cm) and a width of about 25 inches (about 63 cm) to about 35 inches (about 89 cm).

Figure 8:
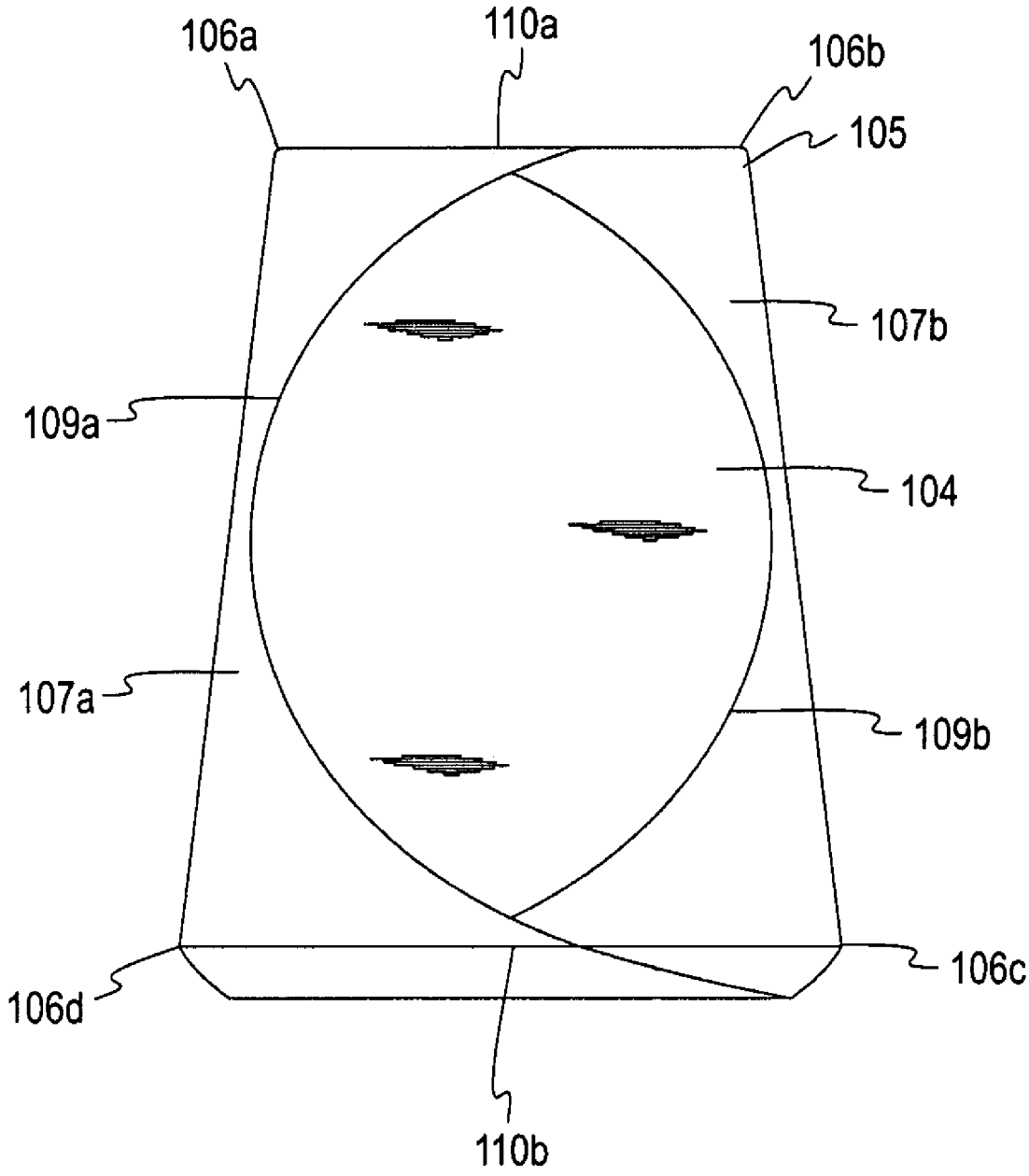
FIG. 8 shows a perspective view of the underside of a mattress having a fitted bed sheet according to one embodiment of the present invention placed thereon.

FIG. 8 shows the underside of a fitted bed sheet 105 according to one embodiment positioned on a mattress 104. The fitted bed sheet 105 of FIG. 8 may be formed using any of the fabric blanks and/or techniques described above. The middle portion of the fitted bed sheet 105 is adapted to generally fit over the top of the mattress 104, and a first side portion 107*a* and second side portion 107*b* are adapted to fit over the sides (see sides 16 of the mattress 20 of FIG. 1) and ends (see ends 18 of the mattress 20 of FIG. 1) of the mattress 104 and to extend around to the bottom, or underside, of the mattress 104 as shown in FIG. 8. Because the fitted bed sheet 105 has more fabric on the underside of the mattress 104 than typical fitted bed sheets, the corners are less likely to become untucked. Thus, the fitted bed sheet 105 is less likely to shift or come off of the mattress 104.

The generally concave edges of the fitted bed sheets described herein provide multiple benefits. For example, the apertures formed as a result of the generally concave edges allow for the fitted bed sheets to be more readily placed on a mattress. More specifically, after placing the fitted bed sheet 105 of FIG. 8, for example, over a first and second corner (e.g., first corner 106*a* and second corner 106*b*) of the mattress 104, generally concave edges 109*a*, 109*b* provide added ease in placing the fitted bed sheet 105 over remaining third and fourth corners (e.g., third corner 106*c* and fourth corner 106*d*) of the mattress 104. Furthermore, when a fitted bed sheet (e.g., fitted bed sheet 105 of FIG. 8) described herein is placed on a mattress (e.g., the mattress 104 of FIG. 8), the overlapping, generally concave edges 109*a*, 109*b* reduce the stress and tension created at a top 110*a* and bottom 110*b* of the fitted bed sheet 105. The stress and tension may be reduced, for example, at the areas where first and second side portions 107*a*, 107*b* are attached to a middle portion (not shown).

It is contemplated that the fitted bed sheets of the embodiments described herein may have one or more plies (e.g., layers). Additionally, although the fabric blanks 30, 65, 66 of the illustrated embodiments are generally symmetrical, the fabric blanks of the embodiments of the present concepts may also be asymmetrical.

According to alternative embodiment A, a fitted bed sheet comprises a generally rectangular middle portion having a first fold line on a first edge and a second fold line on a second opposing edge, a first side portion having a generally concave shape, the first side portion being folded along the first fold line, and a second side portion having a generally concave shape, the second side portion being folded along the second fold line such that the second side portion contacts the first side portion, wherein the first side portion, the middle portion, and the second side portion are coupled along opposing ends generally perpendicular to the first fold line and the second fold line.

According to alternative embodiment B, the bed sheet of alternative embodiment A, wherein lengths and widths of the first side portion, the middle portion, and the second side portion are substantially equal.

According to alternative embodiment C, the bed sheet of alternative embodiment A, wherein the middle portion has a greater width than the first side portion and the second side portion.

According to alternative embodiment D, the bed sheet of alternative embodiment A, further comprising an aperture positioned between the first side portion and the second side portion, the length of the aperture being from about 65% to about 95% of the length of the bed sheet.

According to alternative embodiment E, the bed sheet of alternative embodiment A, wherein the first side portion and the second side portion extend from the middle portion.

According to alternative embodiment F, the bed sheet of alternative embodiment A, wherein at least one of the first side portion, the second side portion, and the middle portion comprises more than one piece of fabric.

According to alternative embodiment G, the bed sheet of alternative embodiment A, wherein the first fold line and the second fold line are not visible.

According to alternative embodiment H, the bed sheet of alternative embodiment A, wherein the first side portion, the second side portion, and the middle portion are comprised of from about 50% by weight to about 55% by weight cotton and from about 40% by weight to about 50% by weight polyester.

According to alternative embodiment I, the bed sheet of alternative embodiment A, wherein the first side portion, the second side portion, and the middle portion are comprised of from about 50% by weight to about 55% by weight cotton, from about 40% by weight to about 50% by weight polyester, and about 1% to about 15% by weight spandex.

According to alternative embodiment J, the bed sheet of alternative embodiment A, wherein the width of the bed sheet is from about 105 inches to about 120' inches and the length of the bed sheet is from about 70 inches to about 85 inches.

According to alternative embodiment K, the bed sheet of alternative embodiment A, further comprising a bias binding positioned on an end of at least one of the first side portion and the second side portion, wherein the end is located generally opposite the corresponding first fold line or second fold line.

According to alternative embodiment L, the bed sheet of alternative embodiment K, wherein the bias binding is an overlock stitch.

According to alternative process M, a method of forming a fitted bed comprises the acts of providing a piece of fabric having a first fold line and a second fold line dividing the fabric into three portions including a first generally concave side portion, a generally rectangular middle portion, and a second generally concave side portion, folding the piece of fabric along the first fold line such that the first side portion overlaps the middle portion, folding the piece of fabric along the second fold line such that the second side portion overlaps the first side portion and the middle portion, and coupling the middle portion, the first side portion, and the second side portion at opposing ends generally perpendicular to the first fold line and the second fold line.

According to alternative process N, the method of alternative process M, wherein the lengths and widths of the middle portion, the first side portion, and the second side portion are substantially equal.

According to alternative process O, the method of alternative process M, wherein the middle portion has a greater width than the first side portion and the second side portion.

According to alternative process P, the method of alternative process M, wherein the bed sheet includes an aperture formed between the first side portion and the second side portion, the length of the aperture being from about 65% to about 95% of the length of the bed sheet.

According to alternative process Q, the method of alternative process M, wherein the first side portion and the second side portion extend from the middle portion.

According to alternative process R, the method of alternative process M, wherein the first fold line and the second fold line are not visible.

According to alternative process S, the method of alternative process M, wherein at least one of the first side portion, the second side portion, and the middle portion are comprised of more than one piece of fabric.

According to alternative process T, the method of alternative process M, wherein the first side portion, the second side portion, and the middle portion are comprised of from about 50% by weight to about 55% by weight cotton and from about 40% by weight to about 50% by weight polyester.

According to alternative process U, the method of alternative process M, wherein the first side portion, the second side portion, and the middle portion are comprised of from about 50% by weight to about 55% by weight cotton, from about 40% by weight to about 50% by weight polyester, and about 1% to about 15% by weight spandex.

According to alternative process V, the method of alternative process M, wherein the width of the bed sheet is from about 105 inches to about 120 inches and the length of the bed sheet is from about 70 inches to about 85 inches.

According to alternative process W, the method of alternative process M, further comprising hemming an end of at least one of the first side portion and the second side portion to form a hemmed end, the hemmed end being positioned opposite the corresponding first fold line or second fold line.

According to alternative process X, the method of alternative process W, further comprising attaching a bias binding to the hemmed end.

According to alternative process Y, the method of alternative process M, wherein the act of coupling the middle portion, the first side portion, and the second side portion at opposing ends generally perpendicular to the first fold line and the second fold line includes using an overlock stitch.

According to alternative process Z, the method of alternative process M, further comprising turning the bed sheet inside out.

According to alternative process AA, the method of alternative process M, further comprising forming the piece of fabric from a generally rectangular piece of fabric by cutting opposing sides of the generally rectangular piece of fabric along cut lines.

According to alternative embodiment AB, a fitted bed sheet comprises a generally rectangular middle portion having a first fold line on a first edge and a second fold line on a second opposing edge, the middle portion having opposing ends generally perpendicular to the first fold line and the second fold line, a first side portion having a generally concave shape, the first side portion being folded along the first fold line such that the first side portion contacts the middle portion, and a second side portion having a generally concave shape, the second side portion being folded along the second fold line such that the second side portion contacts the first side portion and the middle portion, wherein the opposing ends of the middle portion are coupled to adjacent peripheral edges of the second side portion.

According to alternative embodiment AC, the bed sheet of alternative embodiment AB, wherein lengths and widths of the first side portion, the middle portion, and the second side portion are substantially equal.

According to alternative embodiment AD, the bed sheet of alternative embodiment AB, wherein the middle portion has a greater width than the first side portion and the second side portion.

According to alternative embodiment AE, the bed sheet of alternative embodiment AB, further comprising an aperture positioned between the first side portion and the second side portion, the length of the aperture being from about 65% to about 95% of the length of the bed sheet.

According to alternative embodiment AF, the bed sheet of alternative embodiment AB, wherein at least one of the first side portion, the second side portion, and the middle portion comprises more than one piece of fabric.

According to alternative embodiment AG, the bed sheet of alternative embodiment AB, wherein the first fold line and the second fold line are not visible.

According to alternative embodiment AH, the bed sheet of alternative embodiment AB, wherein the first side portion, the second side portion, and the middle portion are comprised of from about 50% by weight to about 55% by weight cotton and from about 40% by weight to about 50% by weight polyester.

According to alternative embodiment AI, the bed sheet of alternative embodiment AB, further comprising a bias binding positioned on an end of at least one of the first side portion and the second side portion, wherein the end is located opposite the corresponding first fold line or second fold line.

According to alternative embodiment AJ, a fitted bed sheet comprises a generally rectangular middle portion having opposing longer edges and opposing shorter edges, a first side portion extending from one of the opposing longer edges of the middle portion, the first side portion having a generally concave peripheral edge, a second side portion extending from the other of the opposing longer edges of the middle portion, the second side portion having a generally concave peripheral edge, a first fold line located between the middle portion and the first side portion, a second fold line located between the middle portion and the second side portion, the first side portion being folded along the first fold line such that the first side portion contacts the middle portion, and the second side portion being folded along the second fold line such that the second side portion contacts the first side portion and the middle portion, wherein the opposing shorter ends of the middle portion are coupled to opposing adjacent edges of the second side portion.

According to alternative embodiment AK, the bed sheet of alternative embodiment AJ, wherein lengths and widths of the first side portion, the middle portion, and the second side portion are substantially equal.

According to alternative embodiment AL, the bed sheet of alternative embodiment AJ, wherein the middle portion has a greater width than the first side portion and the second side portion.

According to alternative embodiment AM, the bed sheet of alternative embodiment AJ, further comprising an aperture positioned between the first side portion and the second side portion, the length of the aperture being from about 65% to about 95% of the length of the bed sheet.

According to alternative embodiment AN, the bed sheet of alternative embodiment AJ, wherein at least one of the first side portion, the second side portion, and the middle portion comprises more than one piece of fabric.

According to alternative embodiment AO, the bed sheet of alternative embodiment AJ, wherein the first fold line and the second fold line are not visible.

According to alternative embodiment AP, the bed sheet of alternative embodiment AJ, wherein the first side portion, the second side portion, and the middle portion are comprised of from about 50% by weight to about 55% by weight cotton and from about 40% by weight to about 50% by weight polyester.

According to alternative embodiment AQ, the bed sheet of alternative embodiment AJ, further comprising a bias binding positioned on an end of at least one of the first side portion and the second side portion, wherein the end is located opposite the corresponding first fold line or second fold line.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the invention, which is set forth in the following embodiments.

What is claimed is:

1. A fitted bed sheet comprising:

a generally rectangular middle portion having a first fold line on a first edge and a second fold line on a second opposing edge;

a first side portion having a generally concave shape, the first side portion being folded along the first fold line such that the first side portion at least partially overlaps a portion of the middle portion; and a second side portion having a generally concave shape, the second side portion being folded along the second fold line such that the second side portion at least partially overlaps a portion of the middle portion and a portion of the first side portion, and wherein the second side portion contacts the first side portion, wherein the overlapping portions of the first side portion, the middle portion, and the second side portion are coupled along opposing ends generally perpendicular to the first fold line and the second fold line.

2. The bed sheet of claim 1, wherein lengths and widths of the first side portion, the middle portion, and the second side portion are substantially equal.

3. The bed sheet of claim 1, wherein the middle portion has a greater width than the first side portion and the second side portion.

4. The bed sheet of claim 1, further comprising an aperture positioned between the first side portion and the second side portion, the length of the aperture being from about 65% to about 95% of the length of the bed sheet.

5. The bed sheet of claim 1, wherein the first side portion and the second side portion extend from the middle portion.

6. The bed sheet of claim 1, wherein at least one of the first side portion, the second side portion, and the middle portion comprises more than one piece of fabric.

7. The bed sheet of claim 1, wherein the first fold line and the second fold line are not visible.

8. The bed sheet of claim 1, wherein the first side portion, the second side portion, and the middle portion are comprised of from about 50% by weight to about 55% by weight cotton and from about 40% by weight to about 50% by weight polyester.

9. The bed sheet of claim 1, wherein the first side portion, the second side portion, and the middle portion are comprised of from about 50% by weight to about 55% by weight cotton, from about 40% by weight to about 50% by weight polyester, and about 1% to about 15% by weight spandex.

10. The bed sheet of claim 1, wherein the width of the bed sheet is from about 105 inches to about 120 inches and the length of the bed sheet is from about 70 inches to about 85 inches.

11. The bed sheet of claim 1, further comprising a bias binding positioned on an end of at least one of the first side portion and the second side portion, wherein the end is located generally opposite the corresponding first fold line or second fold line.

12. The bed sheet of claim 11, wherein the bias binding is an overlock stitch.

13. A method of forming a fitted bed sheet, the method comprising the acts of:

providing a piece of fabric having a first fold line and a second fold line dividing the fabric into three portions including a first generally concave side portion, a generally rectangular middle portion, and a second generally concave side portion;

folding the piece of fabric along the first fold line such that the first side portion overlaps the middle portion;

folding the piece of fabric along the second fold line such that the second side portion overlaps the first side portion and the middle portion; and coupling the overlapping portions of the middle portion, the first side portion, and the second side portion at opposing ends generally perpendicular to the first fold line and the second fold line.

14. The method of claim 13, wherein the lengths and widths of the middle portion, the first side portion, and the second side portion are substantially equal.

15. The method of claim 13, wherein the middle portion has a greater width than the first side portion and the second side portion.

16. The method of claim 13, wherein the bed sheet includes an aperture formed between the first side portion and the second side portion, the length of the aperture being from about 65% to about 95% of the length of the bed sheet.

17. The method of claim 13, wherein the first side portion and the second side portion extend from the middle portion.

18. The method of claim 13, wherein the width of the bed sheet is from about 105 inches to about 120 inches and the length of the bed sheet is from about 70 inches to about 85 inches.

19. The method of claim 13, further comprising hemming an end of at least one of the first side portion and the second side portion to form a hemmed end, the hemmed end being positioned opposite the corresponding first fold line or second fold line.

20. The method of claim 19, further comprising attaching a bias binding to the hemmed end.

21. The method of claim 13, wherein the act of coupling the overlapping portions of the middle portion, the first side portion, and the second side portion at opposing ends generally perpendicular to the first fold line and the second fold line includes using an overlock stitch.

22. The method of claim 13, further comprising turning the bed sheet inside out.

23. The method of claim 13, further comprising forming the piece of fabric from a generally rectangular piece of fabric by cutting opposing sides of the generally rectangular piece of fabric along cut lines.

24. A fitted bed sheet comprising:

a generally rectangular middle portion having opposing longer edges and opposing shorter edges;

a first side portion extending from one of the opposing longer edges of the middle portion, the first side portion having a generally concave peripheral edge;

a second side portion extending from the other of the opposing longer edges of the middle portion, the second side portion having a generally concave peripheral edge;

a first fold line located between the middle portion and the first side portion;

a second fold line located between the middle portion and the second side portion;

the first side portion being folded along the first fold line such that the first side portion contacts and at last partially overlaps the middle portion; and the second side portion being folded along the second fold line such that the second side portion contacts and at least partially overlaps the first side portion and the middle portion, wherein the opposing shorter ends of the middle portion are coupled to opposing adjacent edges of the first side portion and the second side portion.

25. The bed sheet of claim 24, wherein lengths and widths of the first side portion, the middle portion, and the second side portion are substantially equal.

26. The bed sheet of claim 24, wherein the middle portion has a greater width than the first side portion and the second side portion.

27. The bed sheet of claim 24, further comprising an aperture positioned between the first side portion and the second side portion, the length of the aperture being from about 65% to about 95% of the length of the bed sheet.

28. The bed sheet of claim 24, wherein at least one of the first side portion, the second side portion, and the middle portion comprises more than one piece of fabric.

29. The bed sheet of claim 24, wherein the first side portion, the second side portion, and the middle portion are comprised of from about 50% by weight to about 55% by weight cotton and from about 40% by weight to about 50% by weight polyester.

30. The bed sheet of claim 24, further comprising a bias binding positioned on an end of at least one of the first side portion and the second side portion, wherein the end is located opposite the corresponding first fold line or second fold line.

* * * * *